US006230429B1

(12) United States Patent
Smith

(10) Patent No.: US 6,230,429 B1
(45) Date of Patent: May 15, 2001

(54) COMPOSITE TUBE FOR GUN BARREL

(75) Inventor: David B. Smith, Vancouver, WA (US)

(73) Assignee: Magnum Research, Inc., Minneapolis, MN (US)

( * ) Notice: Subject to any disclaimer, the term of this patent is extended or adjusted under 35 U.S.C. 154(b) by 0 days.

(21) Appl. No.: 09/343,868

(22) Filed: Jun. 30, 1999

(51) Int. Cl.[7] ..... F41A 21/02; F41A 3/00; B23P 13/00

(52) U.S. Cl. ..... 42/76.02; 42/76.01; 89/16; 29/1.1; 29/1.11; 428/621; 428/626

(58) Field of Search ..... 42/76.01, 76.02; 29/1.1, 1.11; 89/16; 428/621, 626

(56) References Cited

U.S. PATENT DOCUMENTS

| | | | | |
|---|---|---|---|---|
| 4,137,351 | * | 1/1979 | Clodfelter et al. | 428/34.5 |
| 4,485,721 | * | 12/1984 | Shankhla et al. | 89/15 |
| 4,641,450 | | 2/1987 | Moll . | |
| 4,646,615 | | 3/1987 | Gladstone . | |
| 4,685,236 | | 8/1987 | May . | |
| 4,729,806 | | 3/1988 | Stein . | |
| 5,054,224 | | 10/1991 | Friar . | |
| 5,125,179 | | 6/1992 | Campbell . | |
| 5,191,165 | | 3/1993 | Oskarsson . | |
| 5,600,912 | | 2/1997 | Smith . | |
| 5,692,334 | * | 12/1997 | Christensen . | |
| 5,804,756 | * | 9/1998 | Christensen | 89/15 |
| 5,928,799 | * | 7/1999 | Sherman et al. | 428/655 |

* cited by examiner

*Primary Examiner*—Michael J. Carone
*Assistant Examiner*—K. Kevin Mun

(74) *Attorney, Agent, or Firm*—Gerald E. Helget; Rider, Bennett, Egan & Arundel

(57) ABSTRACT

A composite tube for a gun barrel consists of: an inner tubular metal liner defining a longitudinal bore axis; a resin matrix material surrounding the liner, the resin matrix material containing a plurality of elongate carbon fibers, the carbon fibers being aligned parallel with the longitudinal bore axis of the liner and under compression along the longitudinal bore axis; a muzzle piece attached to the muzzle end of the barrel; and a breech piece attached to the breech end of the barrel, so that any vibrations transmitted along the longitudinal bore axis of the liner are absorbed by the resin matrix material and so that any vibrations reaching the muzzle piece and breech piece are reflected back into the resin matrix material and thus absorbed. A method of manufacturing the composite tube for a gun barrel consists of the steps of:

a) grinding the metal liner down from its original thickness to a greatly reduced thickness;

b) applying the resin matrix material in layers about the metal liner by wrapping a carbon fiber mat with embedded resin about the metal liner under extreme pressure, until a suitable thickness of resin matrix material has been applied to the metal liner;

c) compressing the wrapped resin matrix material;

d) heating the wrapped resin matrix material and enclosed metal liner while maintaining compression on the resin matrix material to cure the resin matrix material;

e) lathing and sanding the cured resin matrix material to the proper diameter for a gun barrel; and f) attaching the muzzle piece and breech piece to the gun barrel with the adhesive material.

18 Claims, 8 Drawing Sheets

COMPOSITE TUBE FOR GUN BARREL

BACKGROUND OF THE INVENTION

This invention relates to a composite tube for a gun barrel and more particularly to a composite tube including carbon fibers and a resin matrix material, with breech and muzzle pieces attached to the gun barrel by an adhesive or threads and enclosing the resin matrix material, so that vibrations in the barrel are reflected into the resin matrix material by the breech and muzzle pieces.

Composite gun barrels are desirable because they permit the construction of lightweight firearms. A composite barrel such as one constructed from a tube made of carbon fiber and epoxy resin materials, however, typically lacks sufficient stiffness to maintain its integrity for accurate reproducible firing. Even when the composite barrel includes an inner tubular liner, a firearm having such a composite barrel tends to be less accurate than a fiream having a conventional barrel.

A composite tube and method of manufacture for a gun barrel is disclosed in U.S. Pat. No. 5,600,912, herein incorporated by reference, and invented by the same inventor. While the composite tube there disclosed has certain advantages over the prior art, the inventor has found that the improvements disclosed and claimed herein add greatly to the accuracy of fire of the gun barrel.

More particularly, the receiver of a firearm in combination with a steel barrel acts like a bell. Since the steel barrel is of one homogeneous material, when a cartridge is fired, the entire system vibrates at a particular frequency. Such vibrations are generally detrimental to the performance of the barrel.

Such vibrations travel down the length of the barrel as soon as the trigger is released and the cocking piece strikes the primer of the cartridge, due to metal-to-metal contact in on all-metal structure. Upon ignition, these vibrations or harmonics increase. As the vibrations travel down the barrel, they cause the barrel to vibrate at a group of frequencies. In the past, part of the art of gunsmithing was to achieve appropriate barrel length to be consistent with the wavelength of these frequencies to minimize barrel vibration.

Barrel vibration causes a bullet to be deflected from the target line, resulting in inaccuracy of fire.

U.S. Pat. No. 5,600,912 disclosed a barrel which helps to eliminate these harmonic vibrations by absorbing the vibrations into a carbon fiber material oriented longitudinally along the barrel. However, the invention disclosed there does not fully eliminate harmonics which reach the muzzle and breech pieces, because the muzzle and breech pieces are not tightly integrated with the carbon fiber material. Also, the carbon fiber material in the '912 patent is not compressed sufficiently to produce optimum fiber density in the resin matrix material.

There is a need for a composite tube for a gun barrel which overcomes the above-discussed deficiencies.

SUMMARY OF THE INVENTION

A composite tube for a gun barrel consists of: an inner tubular metal liner defining a longitudinal bore axis; a resin matrix material surrounding the liner, the resin matrix material containing a plurality of clongate carbon fibers, the carbon fibers being alignced parallel with the longitudinal bore axis of the liner and under compression along the longitudinal bore axis; a muzzle piece attached to the muzzle end of the barrel by adhesive and/or threads; and a breech piece attached to the breech end of the barrel by adhesive and/or threads, so that any vibrations transmitted along the longitudinal bore axis of the liner are absorbed by the resin matrix material and so that any vibrations reaching the muzzle piece and breech piece are reflected back into the resin matrix material and thus absorbed.

A method of manufacturing the composite tube for a gun barrel consists of the steps of:

a) grinding the metal liner down from its original thickness to a greatly reduced thickness;

b) applying the resin matrix material in layers about the metal liner by wrapping a carbon fiber mat with embedded resin about the metal liner under extreme pressure, until a suitable thickness of resin matrix material has been applied to the metal liner;

c) compressing the wrapped resin matrix material;

d) heating the wrapped resin matrix material and enclosed metal liner while maintaining compression on the resin matrix material to cure the resin matrix material;

e) lathing and sanding the cured resin matrix material to the proper diameter for a gun barrel; and f) attaching the muzzle piece and breech piece to the gun barrel.

A principal object and advantage of the present invention is that the breech and muzzle pieces transmit any vibrations from the barrel and receiver back into the resin matrix material, where they are absorbed.

A second principal object and advantage of the present invention is that the method of manufacture rolls the resin matrix material onto the metal liner under extreme pressure, and the resin matrix material is held under strong compression during the manufacture and cure cycles, resulting in greatly increased carbon fiber density in the cured material, with a greatly increased ability to absorb vibrations.

DETAILED DESCRIPTION OF THE PREFERRED EMBODIMENTS

Figure 1:
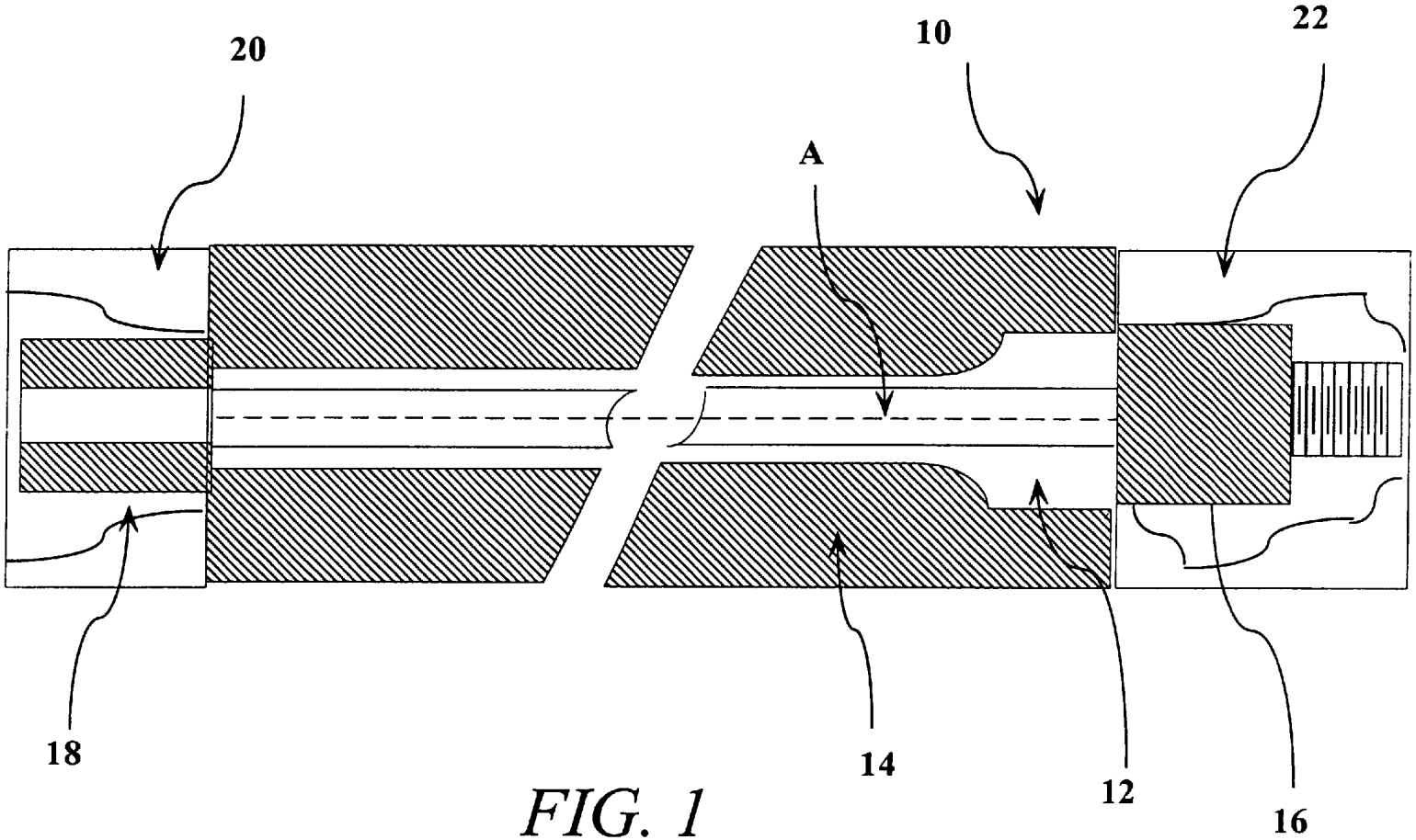
FIG. 1 is a schematic cross-section of the composite gun barrel of the present invention.

The composite tube for a gun barrel of the present invention is generally shown in the Figures as reference numeral 10.

The gun barrel 10 further comprises an inner tubular metal liner 12 having a longitudinal bore axis A.

A resin matrix material 14 surrounds the liner 12 and comprises a plurality of longitudinal carbon fibers 15 aligned parallel with the longitudinal bore axis A. The longitudinal carbon fibers 15 are under compression along the longitudinal axis A as will be described below.

The liner 12 has a breech end 16 and a muzzle end 18. The gun barrel includes a breech piece 22 attached to the breech end 16 and a muzzle piece 20 attached to the muzzle end 18 to compress the carbon fibers therebetween. The breech piece 22 and muzzle piece 20 may be made of any suitable metal, such as brass, copper, or steel. Preferably, they arc steel.

Figure 2:
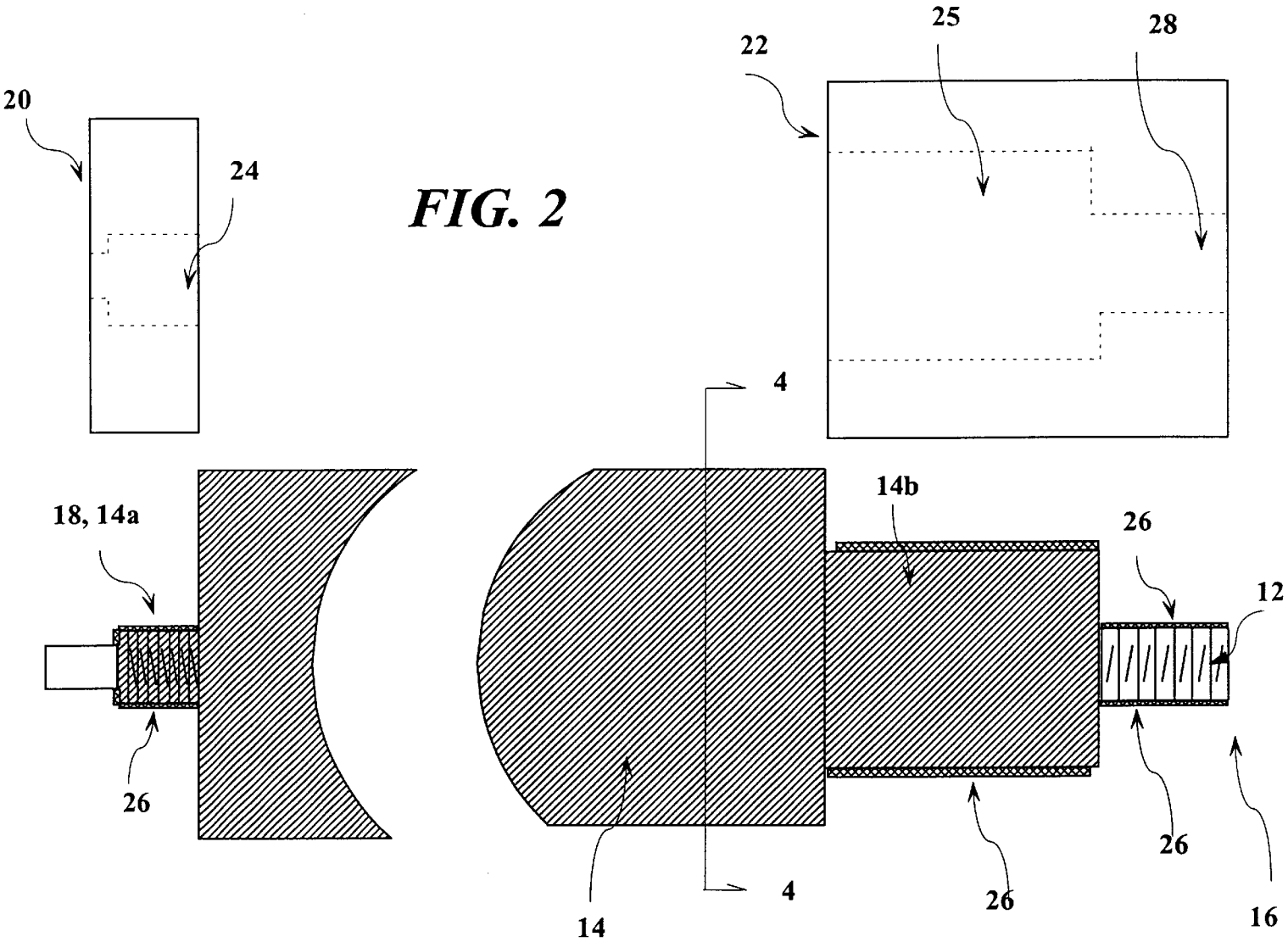
FIG. 2 is a schematic exploded view of the composite gun barrel of the present invention.

As can best be seen in FIG. 2, the muzzle piece 20 has a central core 24 adapted to surround the resin matrix material 14*a* at the muzzle end 18; and the breech piece 22 has a central core 25 adapted to surround the resin matrix material 14*b* at the breech end 16. The breech piece may go approximately 2 inches over the resin matrix material 14*b*. The muzzle piece 20 may go approximately 1 inch over the resin matrix material 14*a*.

An adhesive material 26 is adapted to secure the muzzle piece to the resin matrix material 14*a* at the muzzle end 18 and to secure the breech piece 22 to the resin matrix material 14*b* at the breech end 16. At the breach end 16, the adhesive also secures the breech piece 22 to the metal liner 12. Alternatively, the muzzle piece 20 and breech piece 22 may be secured by threads or by a combination of threads and adhesive material. It has been found that a combination of threads and adhesive material provides the maximum extraction of harmonics from the barrel/receiver combination.

The breech piece thus ties the steel of the breech piece to the metal liner and the steel of the breech piece to the resin matrix material so that any vibrations that reach the breech piece are reflected back into the resin matrix material and there absorbed. Similarly, the muzzle piece ties the metal liner to the resin matrix material to reflect any vibrations reaching the muzzle piece into the resin matrix material for absorption.

Figure 3:
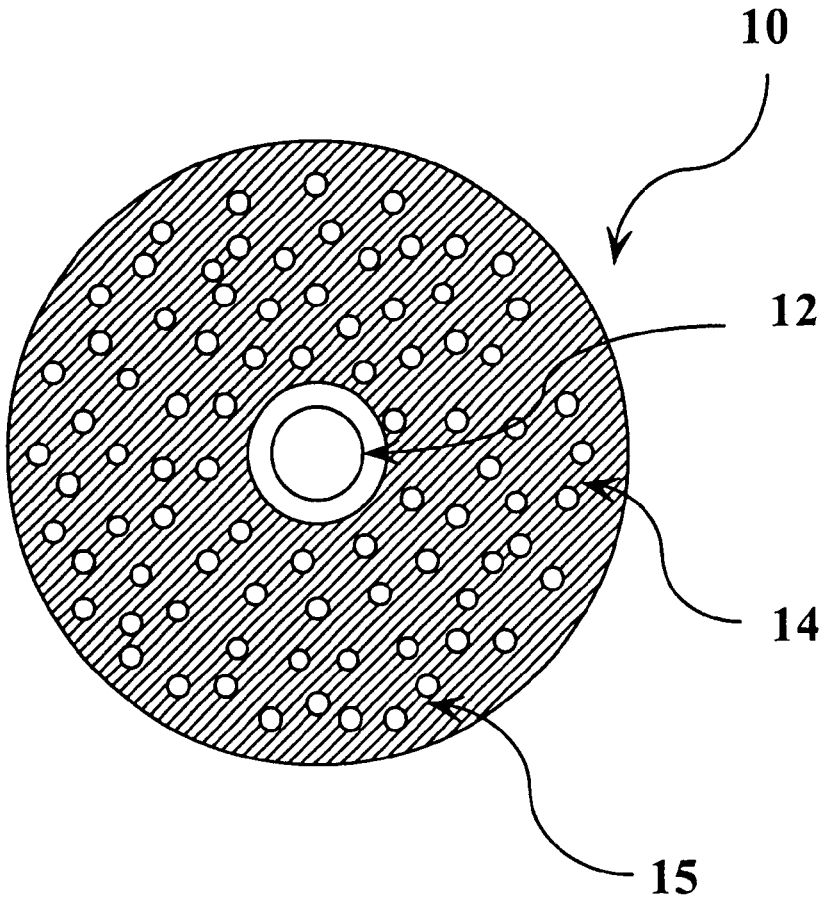
FIG. 3 is a schematic cross-section of the composite gun barrel of the present invention along the lines 4 of FIG. 2.

As can best be seen in FIG. 3, the resin matrix material 14 comprises a plurality of layers of longitudinal carbon fibers 15 embedded therein.

Preferably, the longitudinal carbon fibers 15 are graphite.

In the preferred embodiment, the adhesive material 26 is an epoxy resin.

In the preferred embodiment, the liner 12 protrudes from the resin matrix material 14 at the breech end 16, as best seen in FIG. 2. In turn, the breech piece 22 has an extension 28 encompassing the protruded liner. Preferably, the protruded liner 12 is externally threaded to mate with internal threads on the breech piece extension 28.

Also in the preferred embodiment, the resin matrix material 14*a* at the muzzle end 18 is externally threaded, as shown in FIG. 2, to mate with internal threads on the muzzle piece 20.

It has been found that the liner 12 works best with a wall thickness in a range of about 0.032 to 0.085 inches. Greater thicknesses could be used, but would add to the weight of the barrel.

It has been found that the muzzle piece 20 and breech piece 22 work optimally with wall thicknesses of about 0.032 to 0.085 inches about the externally threaded matrix material and protruded liner, respectively.

Figure 4:
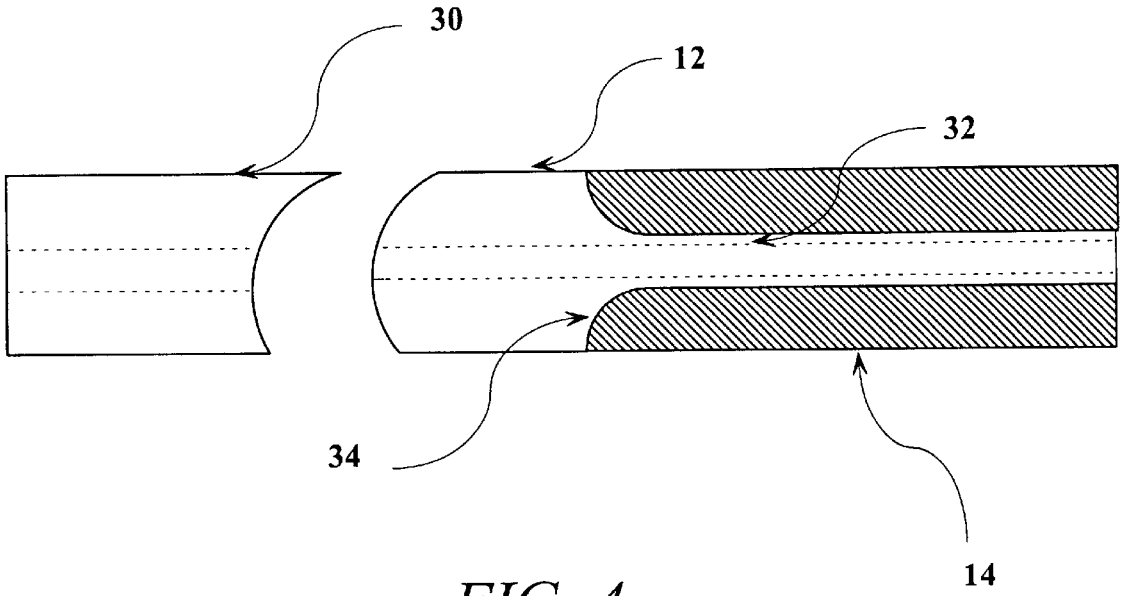
FIG. 4 is a schematic cross-section of the composite gun barrel of the present invention at the beginning of construction.
Figure 5:
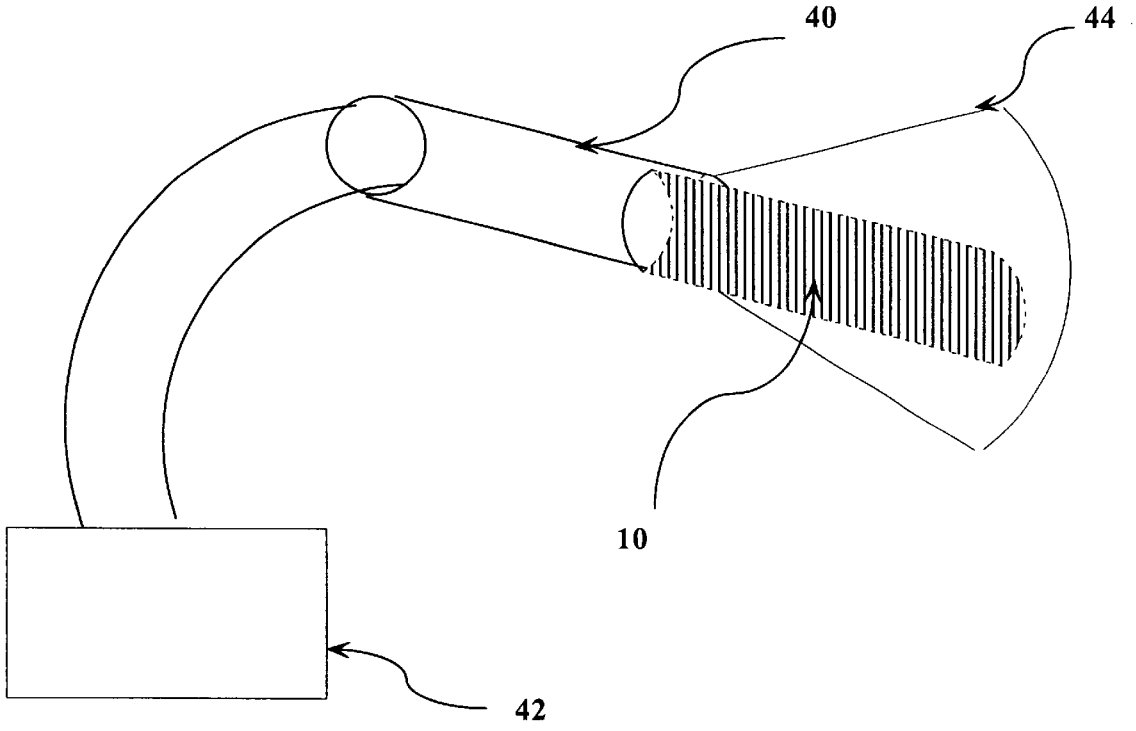
FIGS. 5–8 are schematics which show steps of construction of the composite gun barrel of the present invention.
Figure 6:
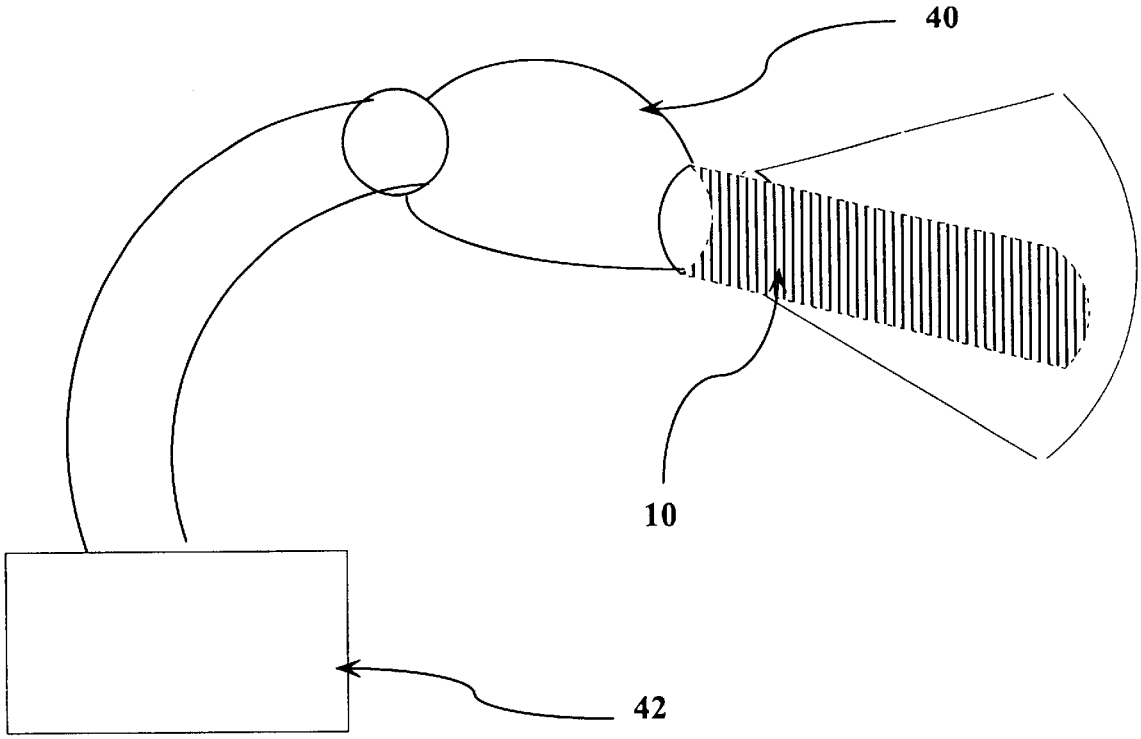
Figure 7:
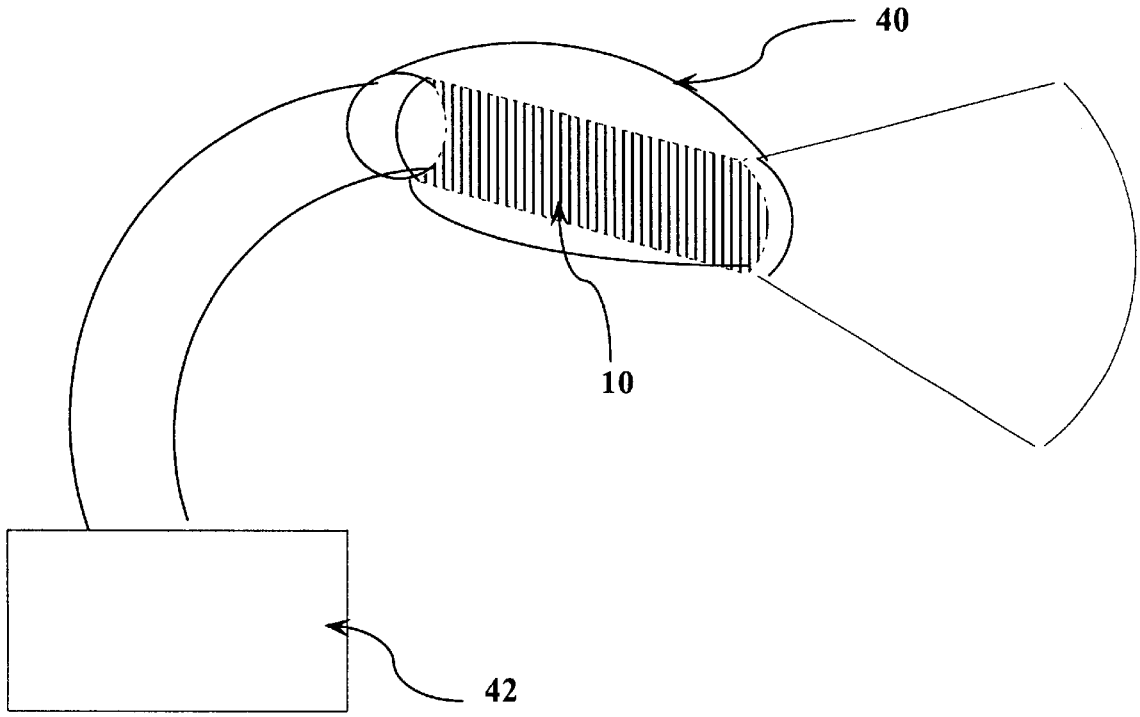

As best seen in FIG. 4, the liner preferably has a first section 30 at the breech end and a narrower second section 32 adjoining the first section, and further comprising a radius 34 between the first section and the second section. The radius 34 is optimally about ¾ inch. The radius 34 allows very heavy vibrations generated by cartridge detonation in the chamber to be absorbed immediately into the resin matrix material 14, thus dampening the vibrations. It also allows the first section to be wider and have thicker walls than the second section, which is important as the first section 30 is nearest the chamber of the gun.

A method of manufacturing the gun barrel 10 of the present invention is illustrated beginning with FIG. 4. In FIG. 4, the metal liner 12 has been ground down from its original thickness to a thickness of about 0.032 to 0.085 inches. The first few layers of resin matrix material 14 have been added.

The material 14 comes in a pre-formed no-scrim, carbon fiber mat. The material is available from a number of sources, including Toray, Inc., 16501 Ventura Blvd., Encino, Calif. 91436. The material includes a resin in the mat.

The material 14 is wrapped in layers around the metal liner 12 under extreme pressure in a manner similar to rolling a cigarette until the thickness needed for the barrel has been achieved. For example, for center-fire barrels, the carbon fiber mat, approximately 0.004 inches thick, is wrapped on through a length of mat. In the case of rim-fire barrels, a shorter length of mat is wrapped on. The extreme pressure may be applied mechanically.

Next, the liner 12 and resin matrix material 14 may be inserted into a silicone bag, 40, available from Aero Rubber Co., Bridgeview, Ill. The internal diameter of the silicone bag must be less than the outer diameter of the barrel, in order to compress the barrel.

Figure 8:
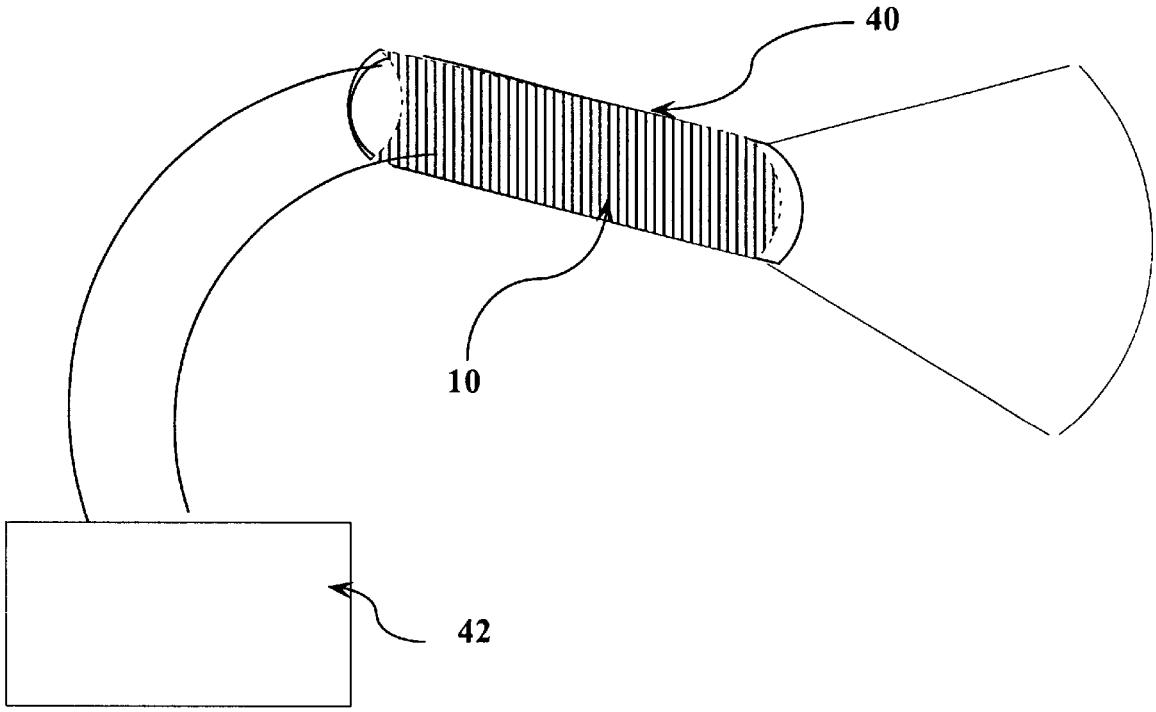

As shown in FIGS. 5–8, the barrel 10 may optimally be inserted into the silicone bag 40 by connecting an air pressure source 42 to one end of the bag 40, putting a funnel 44 of appropriate diameter into the other end, inserting the barrel 10 into the funnel 44 to block the other end of the bag (FIG. 5), inflating the bag 40 with the air pressure source (FIG. 6), sliding the barrel 10 into the silicone bag 40 (FIG. 7), and removing the air pressure. The bag 40 will then collapse and exert a great deal of pressure on the resin matrix material 14 (FIG. 8).

Next, the silicone bag and barrel are heated in a curing oven and cured while still under compression. The temperature and length of time used for curing will vary with different matrix materials and thicknesses, but a suitable temperature and time has been found to be about 300 to 350 degrees Fahrenheit for one to two hours.

The silicone bags with barrels are then removed from the oven, the air pressure source is reattached to the bag, the bag is inflated, and the barrel is removed.

The barrel is then lathed and sanded to produce the proper diameter, concentric with the longitudinal axis of the liner 12.

At this point, shoulders are ground onto the breech and muzzle ends of the barrel to accommodate the breech and muzzle pieces, as can best be seen in FIG. 1. Then adhesive 26 is applied to the externally threaded liner at the breech end 16 and the breech piece 22 is attached to the externally threaded liner 12. Similarly, adhesive 26 is applied to the externally threaded resin matrix material 14*a* at the muzzle end 18 and the muzzle piece 20 is attached to the externally threaded resin matrix material, as best seen in FIG. 2.

As the breech piece and muzzle piece are threaded onto the barrel 10, they compress the resin matrix material 14 between them, making it able to absorb vibrations more readily.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A composite tube for a gun barrel, comprising:

a) an inner tubular metal liner defining a longitudinal bore axis;

b) a resin matrix material surrounding the liner, the resin matrix material containing a plurality of elongate carbon fibers, the carbon fibers being aligned parallel with the longitudinal bore axis of the liner, and under compression along the longitudinal axis;

c) the liner having a breech and a muzzle ends the breech and the muzzle ends surrounded by the resin matrix material, the gun barrel including a muzzle piece attached to the muzzle end of the liner and a breech piece attached to breech end of the liner to compress the carbon fibers;

d) the muzzle piece and the breech piece each having a central core adapted to surround the resin matrix material at the muzzle end and breech end, respectively;

whereby any vibrations transmitted along the longitudinal bore axis of the liner are absorbed by the resin matrix material and whereby any vibrations reaching the muzzle piece and breech piece are reflected back into the resin matrix material and there absorbed.

2. The gun barrel of claim 1, wherein the resin matrix material comprises a plurality of layers.

3. The gun barrel of claim 1, wherein the carbon fibers are graphite.

4. The gun barrel of claim 1, further comprising an adhesive material adapted to secure the muzzle piece and the breech piece to the resin matrix material at the muzzle end and breech end, respectively.

5. The gun barrel of claim 1, wherein the liner protrudes from the resin matrix material at the breech end and the breech piece has an extension encompassing the protruded liner.

6. The gun barrel of claim 5, wherein the protruded liner is externally threaded to mate with internal threads on the breech piece extension.

7. The gun barrel of claim 1, wherein the resin matrix material at the muzzle end is externally threaded to mate with internal threads on the muzzle piece.

8. The gun barrel of claim 7, wherein the muzzle piece has walls about 0.032 to 0.085 inches thick encompassing the externally threaded resin matrix material.

9. The gun barrel of claim 1, wherein the liner has a thickness of about 0.032 to 0.085 inches.

10. The gun barrel of claim 5, wherein the breech piece extension has walls about 0.032 to 0.085 inches thick encompassing the protruded liner.

11. The gun barrel of claim 1, wherein the liner has a first section at the breech end and a narrower second section adjoining the first section, and further comprising a radius between the first section and the second section.

12. The gun barrel of claim 11, wherein the radius is about ¾ inch.

13. The gun barrel of claim 1, wherein the breech piece overlaps the resin matrix material by about 2 inches and wherein the muzzle piece overlaps the resin matrix material by about 1 inch.

14. A composite tube for a gun barrel, comprising:

a) an inner tubular metal liner defining a longitudinal bore axis;

b) a resin matrix material surrounding the liner, the resin matrix material containing a plurality of elongate carbon fibers, the carbon fibers being aligned parallel with the longitudinal bore axis of the liner, and under compression along the longitudinal axis;

c) the liner having a breech and a muzzle ends, the breech and the muzzle ends surrounded by the resin matrix material, the gun barrel including a muzzle piece attached to the muzzle end of the liner and a breech piece attached to breech end of the liner to compress the carbon fibers;

d) the muzzle piece and the breech piece each having a central core adapted to surround the resin matrix material at the muzzle end and breech end, respectively;

e) an adhesive material adapted to secure the muzzle piece and the breech piece to the resin matrix material at the muzzle end and breech end, respectively; and f) wherein the liner has a first section at the breech end and a narrower second section adjoining the first section, and further comprising a radius between the first section and the second section;

whereby any vibrations transmitted along the longitudinal bore axis of the liner are absorbed by the resin matrix material and whereby any vibrations reaching the muzzle piece and breech piece are reflected back into the resin matrix material and there absorbed.

15. The gun barrel of claim 14, wherein the resin matrix material comprises a plurality of layers.

16. The gun barrel of claim 14, wherein the resin matrix material at the muzzle end is externally threaded to mate with internal threads on the muzzle piece.

17. The gun barrel of claim 14, wherein the liner protrudes from the resin matrix material at the breech end and the breech piece has an extension encompassing the protruded liner.

18. The gun barrel of claim 17, wherein the protruded liner is externally threaded to mate with internal threads on the breech piece extension.

* * * * *